United States Patent [19]

Hugemann et al.

[11] 4,285,907

[45] Aug. 25, 1981

[54] PIPETTE SYSTEM FOR THE VOLUMETRIC EXTRACTION AND LINEAR DEPOSITION OF A SUSPENDED MATERIAL

[75] Inventors: Bernhard Hugemann, Frankfurt am Main; Guenter von Sengbusch, Koenigstein, both of Fed. Rep. of Germany

[73] Assignee: Battelle Institut e.V., Frankfurt am Main, Fed. Rep. of Germany

[21] Appl. No.: 69,332

[22] Filed: Aug. 24, 1979

[30] Foreign Application Priority Data

Aug. 26, 1978 [DE] Fed. Rep. of Germany ..... 2837319

[51] Int. Cl.[3] ..... B01L 3/02

[52] U.S. Cl. ..... 422/100; 73/864.13

[58] Field of Search ..... 73/425.4 P, 425.6; 422/100; 128/763, 765, 234

[56] References Cited

U.S. PATENT DOCUMENTS

| | | | |
|---|---|---|---|
| 1,027,246 | 5/1912 | Granville | 73/425.6 |
| 2,376,231 | 5/1945 | Cohn | 422/100 |
| 4,140,488 | 2/1979 | Mack et al. | 422/100 |

FOREIGN PATENT DOCUMENTS 1900808 8/1970 Fed. Rep. of Germany .

*Primary Examiner*—William F. Smith
*Assistant Examiner*—Chris Konkol
*Attorney, Agent, or Firm*—Fisher, Christen & Sabol

[57] ABSTRACT

Pipette system for the volumetric extraction and linear deposition of a suspended material, in particular cells or particles. The pipette system consists of a capillary containing a piston inserted in such a way as to prevent the passage of liquids. Part of the rim forming the orifice of the capillary has a projection. The width of the projection determines the width of the smear regardless of the diameter of the capillary, even when the deposition of the suspension onto the slide or the like is contactless.

10 Claims, 2 Drawing Figures

PIPETTE SYSTEM FOR THE VOLUMETRIC EXTRACTION AND LINEAR DEPOSITION OF A SUSPENDED MATERIAL

BACKGROUND OF THIS INVENTION

1. Field of This Invention

This invention relates to a pipette system for the volumetric withdrawal and linear deposition of a suspended material, in particular cells or particles. This invention also relates to a pipette system consisting of a capillary containing a piston inserted in such a way as to prevent the passage of liquids.

2. Prior Art

Suspensions are routinely produced and prepared for medical and diagnostic purposes, e.g., examinations of blood or cells. A standard method is the plane preparation of a cell suspension on a microscope slide, a second slide being used to spread the cell suspension over the whole surface of the slide or to obtain a thin layer. The disadvantage of such process is that the cells and the liquid adhere to the auxiliary slide that is used to distribute the suspension. This means that part of the suspension is wasted, and it is no longer possible to count the exact number of cells in the original volume. In addition, the distribution of the cells is plane and sometimes uneven. If greater magnification is used, making the area to be examined greater than the field of view of the microscope, marginal cells make automated analysis of the cells difficult, and automated evaluation of the sample becomes complicated and expensive.

Devices are known which permit linear application of the sample to the carrier and automatic evaluation of the material under examination (e.g., German O.S. 1,900,808). In such case the suspension is deposited linearly on the carrier which is in the form of a ribbon, the width of the deposit corresponding to the diameter of the field of view of the microscope. Deposition is effected by a drawing pen formed by two metal tongues (the distance between the tongues may be varied) and the suspension volume to be deposited passes between them. The tip of the metal tongues must come into contact with the carrier during deposition in order to permit the suspension to flow out. With such a device it is not possible to achieve a volumetric, proportional deposition of particles from suspensions in the form of a line of specific breadth and length within a given space of time and at a given deposition speed because both particles and liquid adhere to the surfaces of the metal tongues that come into contact with the suspension and because the rate of discharge of the suspension is dependent both on its surface tension and on the wetting properties of the carrier. A further major disadvantage is that it is necessary to clean the system prior to each change of sample in order to prevent the entrainment of cells.

Even when the metal tongue discharge device is replaced by a micropipette system where a piston is inserted into a capillary tube so as to prevent the passage of liquid and in such a way that it can be moved axially by means of a miniature electric motor with reduction gear towards the orifice of the capillary according to the volume to be taken up and later discharged and so that it seals the capillary on completion of the process, the demands, especially for larger suspension volumes (e.g., $>1$ μl) with a pre-selectable width of smear, are still not satisfied.

The width of the cell smear that can be achieved corresponds to the outside diameter of the tip of the pipette and is only slightly wider than the diameter of the capillary if the tube has a conically tapered shape at the orifice. The particle suspension is discharged by force by the motion of the piston and when a motor is used the rate of discharge is infinitely variable. The piston seal ensures that the capillary is completely emptied, leaving no residues. An important advantage of this type of pipette is that the forced discharge of the suspension from the pipette eliminates the need for the tip of the pipette to come into contact with the carrier, thus preventing wear of the tip and damage to the surface of the carrier. Material is no longer carried over into the next sample, and the pipette does not need to be cleaned so frequently. This system can be used, for example, for the contactless deposition of a smear 0.3 mm wide and between 5 and 50 cm long from 0.15 μl of liquid, where the system has a capillary with an inside diameter of 0.2 mm, the outside diameter at the tip being 0.3 mm, and where the piston stroke is ca. 4.8 mm. The disadvantage of this kind of pipette is, however, that it can only be used for volumes in the range of 0.1 to 0.5 μl. For example, in order to deal with a volume greater than 1.5 μl the piston stroke would have to be more than 50 mm, but this would cause substantial instability, making the equipment useless.

In the field of medical engineering, and in particular for early diagnosis of cancer, it must be possible to treat cell suspension volume of up to several μl with the above accuracy. It is simple to withdraw a larger quantity of cell suspension by increasing the diameter of the capillary. But it is then no longer possible to achieve the required width of the smear (0.3 mm or less) since the width of the smear is directly dependent on the diameter of the tip of the capillary and cannot be smaller than the diameter of the capillary.

BROAD DESCRIPTION OF THIS INVENTION

An objects of this invention is to provide a pipette system which overcomes the stated prior art problems. Another object of this invention is to provide a pipette system which can be used to extract specific predetermined quantities from a cell or particle suspension and which permits contactless deposition of these quantities in the form of a linear or spiral-shaped smear on a suitable carrier, e.g., plastic tape or glass slide. Other objects and advantages of this invention are set out herein or are obvious herefrom to one ordinarily skilled in the art.

The objects and advantages of this invention are achieved by the pipette system of this invention.

This invention involves a pipette system for the volumetric withdrawal and linear deposition of a suspended material, in particular cells or particles. The pipette system consists of a capillary containing a piston inserted in such a way as to prevent the passage of liquids. The main feature of this invention is that is can be used to deposit a specific quantity of a cell or particle suspension in the form of a line of a certain length and breadth on a suitable carrier.

It has now become clear that the objects of this invention are achieved in a technically advanced way using the pipette system according to this invention, where a projection is mounted on or is part of the rim forming the orifice of the capillary of the pipette, the width of the projection determining the width of the smear regardless of the diameter of the capillary, even when the deposition of the suspensions onto the slide or the like is contactless.

The projection preferably has a lengthwise groove or slot, the width of which is smaller than the diameter of the suspended cells or particles in order to prevent the cells or particles from becoming trapped in the groove. The groove or slot reaches to the end of the path of the piston stroke so that the total volume of suspension can be discharged. In this way the liquid can flow right to the tip of the projection due to the capillary force which is produced in the groove or slot.

The same effect can be obtained by hydrophilic coating of the projection. Compounds that can be used to form a hydrophilic coating are already well known.

The projection can be mounted on the rim of the orifice of the capillary. It is preferable to shape part of the rim of the orifice of the capillary so as to form a projection.

DETAILED DESCRIPTION OF THIS INVENTION

Figure 1:
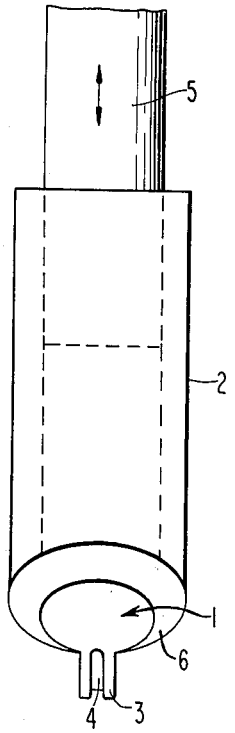

The following details of this invention rely upon the diagrams of a single preferred embodiment.

Figure 2:
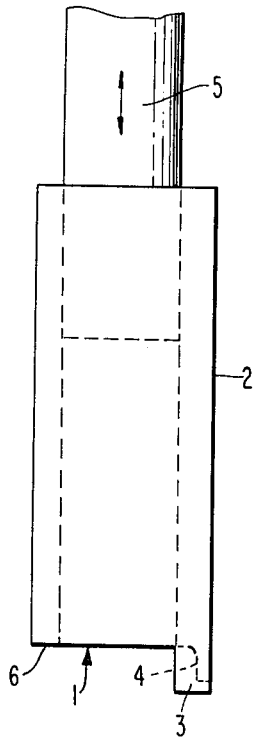

In the drawings:

FIG. 1 is a simplified, schematic, perspective view of a pipette system according to this invention; and FIG. 2 is a simplified, schematic, side view of the same pipette system.

From the drawings it is seen that rim 6 of orifice 1 of capillary 2 has projection 3. The shape of orifice 1 is such that orifice 1 is tightly sealed by pistons when the discharge process is completed. The width of projection 3 determines the width of the smear. Projection 3 has groove 4. The capillary force arising in groove 4 makes it easy for the liquid to flow right to the tip and form a drop. The width of groove 4 is smaller than the diameter of the suspended cells or particles in order to prevent the cells or particles from becoming trapped in groove 4.

Piston 5 can be moved axially in capillary 2 by means of a minature electric motor (not shown) with reduction gears (not shown).

Using the pipette system of this invention one can predetermine the length of the smear, so that the surface density and distribution of the cells or particles in the smear are optimum. Special shaping of the tip of the pipette permits the width of the smear to be adapted to meet specific requirements, e.g., for automated microscopic evaluation, irrespective of the inside diameter of the pipette. If, for example, the width of the smear is so adjusted that the total width of the smear is always in the field of view of a microscope, continuous movement of the smear through the field of view permits all cells or particles to be successively analysed without any difficulties arising due to marginal cells.

What is claimed is:

1. Pipette system for the volumetric extraction and linear deposition of a suspended material, in particular cells or particles, said pipette system consisting essentially of a capillary containing a piston inserted therein in such a way as to prevent the passage of liquids, characterized in that a projection is mounted on or is part of the rim forming the orifice of said capillary, said projection only extending partway around the circumference of said rim, said projection not extending past the rim in any manner into the region of said orifice, said projection having a groove extending along the entire length of said projection and reaching right to the tip of said projection, said groove in said projection not extending past the rim into the region of said orifice, the width of said projection determining the width of the deposition regardless of the diameter of said capillary, even when the deposition of the suspension onto a slide or the like does not involve contract with said slide, the inner diameter of said rim of said orifice being equal to the inner diameter of said orifice throughout the rest of the entire capillary region into which the suspended material is drawn, and the end surface of said piston is flat and perpendicular to the axis of movement of said piston.

2. Pipette system as claimed in claim 1 wherein said projection is mounted on said rim of said orifice of said capillary.

3. Pipette system as claimed in claim 1 wherein part of said rim of said orifice of said capillary is shaped into said projection.

4. Pipette system as claimed in claim 1 wherein a groove covering the length of said projection and reaching right to the tip of said projection is provided with wettability.

5. Pipette system as claimed in claim 4 wherein said projection is mounted on said rim of said orifice of said capillary.

6. Pipette system as claimed in claim 4 wherein part of said rim of said orifice of said capillary is shaped into said projection.

7. Pipette system as claimed in claim 1 or claim 4 wherein said projection contains a hydrophilic coating in order to improve the wettability of said projection.

8. Pipette system as claimed in claim 7 wherein said projection is mounted on said rim of said orifice of said capillary.

9. Pipette system as claimed in claim 7 wherein part of said rim of said orifice of said capillary is shaped into said projection.

10. Pipette system as claimed in claim 1 wherein said projection contains a groove which has a width smaller than the diameter of said suspended material.

* * * * *